United States Patent [19]

Sullivan

[11] 3,959,418

[45] May 25, 1976

[54] CARBURETOR

[75] Inventor: Francis Sullivan, Thousand Oaks, Calif.

[73] Assignee: James T. Scott, Chatsworth, Calif. ; a part interest

[22] Filed: May 8, 1975

[21] Appl. No.: 575,827

[52] U.S. Cl. ..... 261/50 R; 261/64 A; 261/121 A

[51] Int. Cl.[2] ..... F02M 9/06; F02M 17/02

[58] Field of Search ..... 261/50 R, 64 R, 64 A, 261/64 B, 121 A, DIG. 38

[56] References Cited

UNITED STATES PATENTS

| | | | |
|---|---|---|---|
| 1,072,492 | 9/1913 | Pierson | 261/121 A |
| 1,107,713 | 8/1914 | Shakespeare et al. | 261/64 A |
| 1,184,541 | 5/1916 | Kustel | 261/50 R |
| 1,272,379 | 7/1918 | Collins | 261/50 R |
| 1,765,654 | 6/1930 | Carter | 261/50 R |
| 1,973,362 | 9/1934 | Weiertz et al. | 261/121 A |
| 2,538,569 | 1/1951 | Kittler et al. | 261/64 R |
| 3,273,868 | 9/1966 | Morton | 261/50 A |

*Primary Examiner*—Tim R. Miles
*Assistant Examiner*—Gregory N. Clements
*Attorney, Agent, or Firm*—Harvey S. Hertz

[57] ABSTRACT

A carburetor comprises a mixture outlet and a connection for attaching the mixture outlet to an intake manifold. A main air intake is spaced from the mixture outlet and has a butterfly valve adjustable to control the flow of air into the carburetor. The carburetor also has a fuel inlet. A pair of spaced apart surfaces forms a fuel path from a central portion of the spaced apart surfaces to the periphery of the surfaces. The periphery is adjacent to the carburetor passageway for enabling air from the main air inlet to mix with the fuel and pass to the intake manifold. A central fuel inlet forms a path for fuel from the carburetor fuel reservoir to the surfaces central portion. The central fuel inlet comprises an elongated axially movable tube whose outer surface is tapered. A cylindrical member has its inner surface surrounding the elongated tube outer surface. The cylindrical member and the tube when spaced apart define a main fuel path from the fuel reservoir to the central portion of the surfaces. A secondary air inlet forms an air intake passageway when the main air inlet is closed. The secondary air inlet is defined by a first bore formed in the interior of the elongated tube extending from the carburetor exterior adjacent the main air intake to the central portion of the surfaces. A secondary fuel inlet forms a fuel inlet passageway for mixing with the air in the secondary air inlet. The secondary fuel inlet comprises a second bore in the elongated tube which extends from the fuel reservoir to the central portion of the surfaces. At least one orifice communicates with the bores at the central portion surfaces. A needle is movable with respect to the elongated tube in the first bore for adjusting the flow of the air-fuel mixture through the orifice.

4 Claims, 4 Drawing Figures

CARBURETOR

BACKGROUND OF THE INVENTION

1. Field of the Invention

The field of art to which the invention pertains includes the field of carburetors, particularly with respect to a carburetor which can efficiently provide a desirable air-fuel mixture with a minimum of moving parts.

2. Description of the Prior Art

Conventional carburetors contain a venturi throat of a fixed or variable size to provide sufficient pressures where the vaporized fuel is mixed with the air stream to provide for combustion thereof as required to supply power for the operation of the engine. Typically, where the vaporization occurs, at the periphery of the fuel and air paths, it has been found desirable to move a portion of the carburetor so that the venturi is varied when it is desired to vary the flow of air at the mixture point. Such carburetors have been found to be very complex in design and subject to breakdown.

Known prior art includes U.S. Pat. Nos. 2,887,309; 2,939,776; 3,273,869; 2,841,374; and 2,742,721.

The present invention provides a relatively novel carburetor construction wherein fuel is fed to the periphery of a pair of parallel surfaces which is then mixed with a variable air supply. The air supply is controlled by the throttle mechanism of the automobile. When the automobile is idling a secondary fuel air mixture is provided to the engine. The carburetor further eliminates the need for a choke mechanism.

SUMMARY OF THE INVENTION

A carburetor having a mixture outlet and a connection to attach the mixture outlet to an intake manifold. A main air intake is spaced from the mixture outlet and is formed of a butterfly valve adjustable to control the flow of air into the carburetor. A pair of spaced apart surfaces form a fuel path from a central portion of the spaced apart surfaces to the periphery of the surfaces. The periphery of the surfaces are adjacent to the carburetor passageway for enabling air from the main air inlet to mix with fuel and pass to the intake manifold. A central fuel inlet forms a path of fuel from the carburetor fuel resevoir to the surfaces central portion. The central fuel inlet comprises an elongated tube, axially movable, whose outer surface is tapered. A cylindrical member contains an inner surface which surrounds the elongated tube outer surface. The tube and the cylindrical member are spaced apart and define a main fuel path from the fuel resevoir to the central portion of the surfaces. A secondary air inlet forms an air intake passageway when the main air inlet is closed. The secondary air inlet is defined by a bore formed in the interior of the elongated tube which extends from the carburetor exterior adjacent the main air intake to the central portion of the surfaces. A secondary fuel inlet is formed of a fuel inlet passageway which mixes with air in the secondary air inlet and comprises a second bore in the elongated tube which extends from the fuel reservoir to the central portion of the surfaces. An orifice communicates with the bores in the central portion. A needle is movable with respect to the elongated tube in the first bore for adjusting the air-fuel flow through the orifice.

The advantages of this invention, both as to its construction and mode of operation, will be readily appreciated as the same becomes better understood by reference to the following detailed description when considered in connection with the accompanying drawings in which like reference numberals designate like parts through the figures.

DESCRIPTION OF THE PREFERRED EMBODIMENTS

Figure 1:
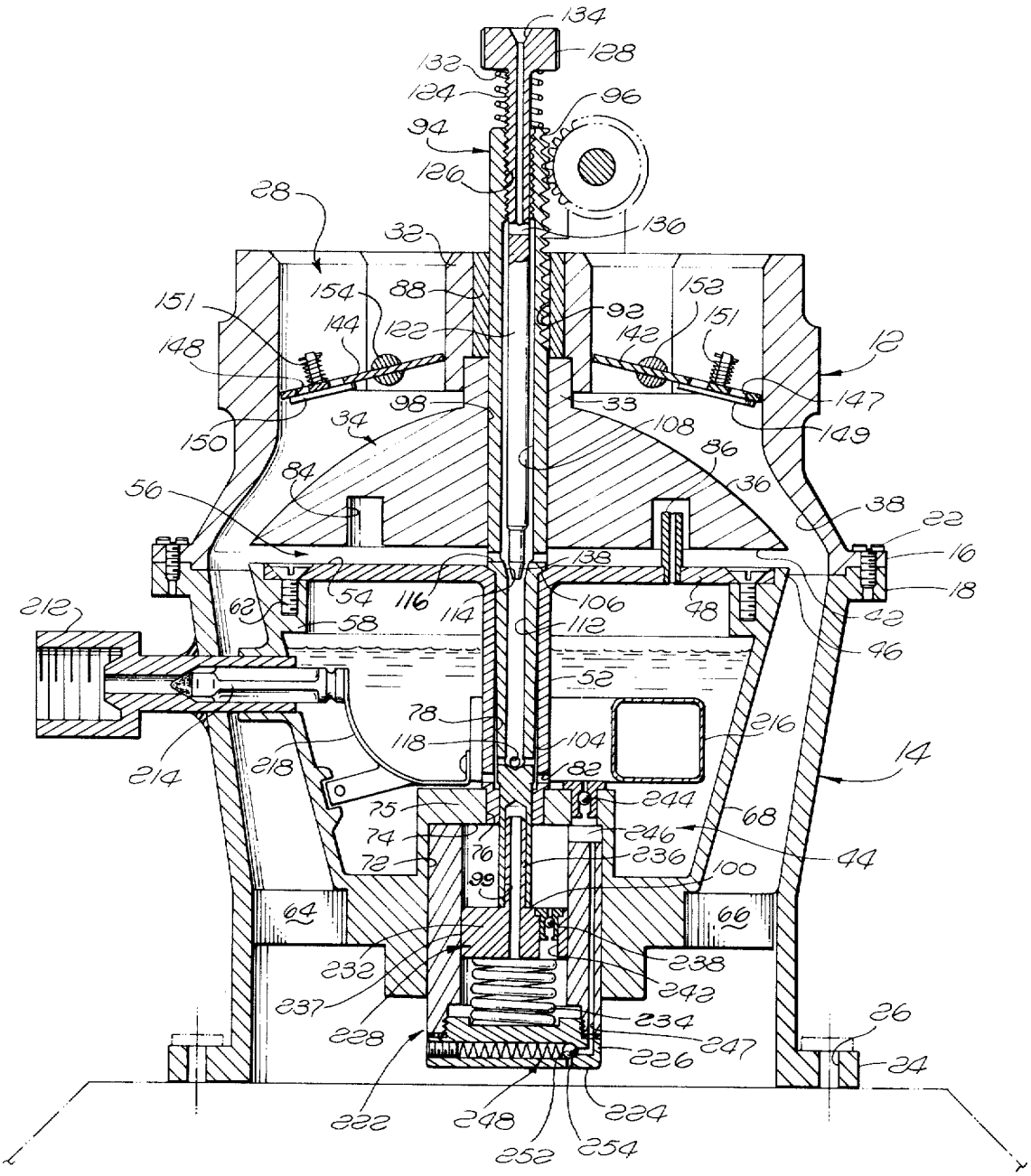
FIG. 1 is a cross-sectional view, illustrating the carburetor of the present invention.

Referring now to the drawings there is shown in FIG. 1 a cross-sectional view of a carburetor constructed in accordance with the principles of the invention. The carburetor is formed of an upper housing member 12 and a lower housing member 14 both of generally cylindrical configuration which are joined together at an outwardly extending upper housing flange 16 and a lower housing flange 18, respectively, by means of screws 22. The upper and lower housing members flare outwardly adjacent the upper and lower housing flanges.

The other end of the lower housing member 14 contains a manifold flange 24 enabling the carburetor to be secured through flange openings 26 to the engine intake manifold (not shown). A central upper opening 28 in the upper housing member 12 forms the main air intake for the carburetor. A central plug 32 is positioned in the opening 28 and is secured to a base 33 of a generally hemispheric shaped member 34. The upper surface 36 of the hemispheric member flares outwardly toward the interior wall 38 of the upper housing member 12 and terminates at the bottom planar surface 42 formed in the plane of the upper housing flange 16.

A fuel chamber 44 is formed of a generally cup shaped configuration with the chamber upper perimeter 46 having a diameter approximately equal in diameter to the diameter of the hemispheric shaped member at its bottom planar surface 42. The top of the fuel chamber is covered by means of an annular plate 48 which contains a central stem 52 extending into the fuel chamber. The top surface 54 of the annular plate is positioned parallel to the hemispheric shaped member planar surface 42 and is spaced thereform so as to form a gap 56.

An inwardly extending flange 58 adjacent the fuel chamber upper perimeter 46 enables the annular plate 48 to be secured to the fuel chamber 44 by means of screws 62.

The fuel chamber is normally integrally connected to the lower housing member 14 by means of a pair of posts 64 and 66. The cup-shaped fuel chamber 44 side walls 68 taper at a slightly greater angle than the lower housing member 14 toward the manifold flange 24 so as to form an increasing spacing intermediate the side wall of the lower housing member 14. The central bottom portion of the fuel chamber 44 contains an inwardly extending bore 72 which terminates at a downwardly facing shoulder 74 of a flange 75 with a central aperture 76 formed in the flange 75. The central stem 52 extends through the aperture 76 and terminates in a plane parallel to the shoulder 74. The stem 52 contains a central bore 78 which forms a fuel passageway communicating to the fuel chamber through openings 82 positioned directly above the flange 75 and in a plane transverse to the axis of the central bore 78.

An annular slot 84 is formed in the hemispheric shaped member bottom planar surface 42. A fuel vent 86 extends into the fuel chamber annular plate 48 and enables gases to vent into the annular slot 84.

A cylindrical slug 88 is positioned in the central plug 32 and contains an interior bore 92 which is axially aligned with the central stem bore 78. A cylindrical sleeve 94 is inserted through the interior bore 92. The cylindrical sleeve 94 contains a rack gear 96 on its outer surface portion which extends above the cylindrical slug 88. The sleeve 94 extends through the slug 88, through a bore 88 formed in the hemispheric shaped member 34, and into the stem central bore 78. The sleeve 94 then extends below the shoulder 74, and contains a downwardly facing bore 99 at the sleeve end 100. The bore 99 extends from about the sleeve end 100 to the flange 75 when the sleeve 94 is in the position shown in FIG. 1.

The outer diameter of the cylindrical sleeve 94 portion in the hemispheric shaped member bore 98 forms a tight slidable fit therein. The outer surface of the cylindrical sleeve 94 in the stem central bore 78 has a tapered outer surface 104 forming an enlarged separation as it extends toward the sleeve openings 82. A downwardly facing sleeve shoulder 106 above the tapered outer surface 104 abuts the bore 78 opening in the plane of the annular plate top surface 54 limiting downward movement of the cylindrical sleeve 94.

The interior of the cylindrical sleeve 94 contains an enlarged diameter upper bore portion 108 and a reduced diameter lower bore portion 112. When the cylindrical sleeve 94 has been inserted a maximum distance into the carburetor and is in the position shown in FIG. 1, the bore portions 108 and 112 are interconnected by a tapered surface 114 in approximately the plane of the spacing between the annular plate top surface 54 and the hemispheric shaped member bottom planar surface 42. A plurality of openings 116 form a path between the gap 56 and the interior of the cylindrical sleeve 94 at the tapered surface 114. Additionally, a plurality of lower openings 118 in the sleeve 94 adjacent the flange 75 allow communication between the lower bore 112 and the area intermediate the cylindrical sleeve tapered outer surface 104 and the interior surface defined by the central bore 78.

A needle 122 is movable in the enlarged diameter upper bore 108 of the cylindrical sleeve 94. The needle 122 has a diameter less than the upper bore 108 and has a threaded upper end 124 which enables the needle to be adjustably inserted into a threaded portion 126 of the cylindrical sleeve 94 directly above the enlarged diameter upper bore 108. The needle 122, which forms an idle adjustment as will be explained hereinafter, has an adjustment knob 128 at its upper end. A spring 132 is spaced intermediate the top surface of the cylindrical sleeve 94 and the bottom surface of the knob 128 in order to keep the needle in a desired position. An air passageway 134 extends from the top surface of the knob 128 to the interior of the cylindrical sleeve 94, enabling air to flow through transverse openings 136 to the area intermediate the outer surface of the needle 122 and the enlarged diameter upper bore 108. A tapered end 138 of the needle extends into the area defined by the tapered surface 114 intermediate the upper and lower bores 108 and 112 of the cylindrical sleeve 94.

Figure 2:
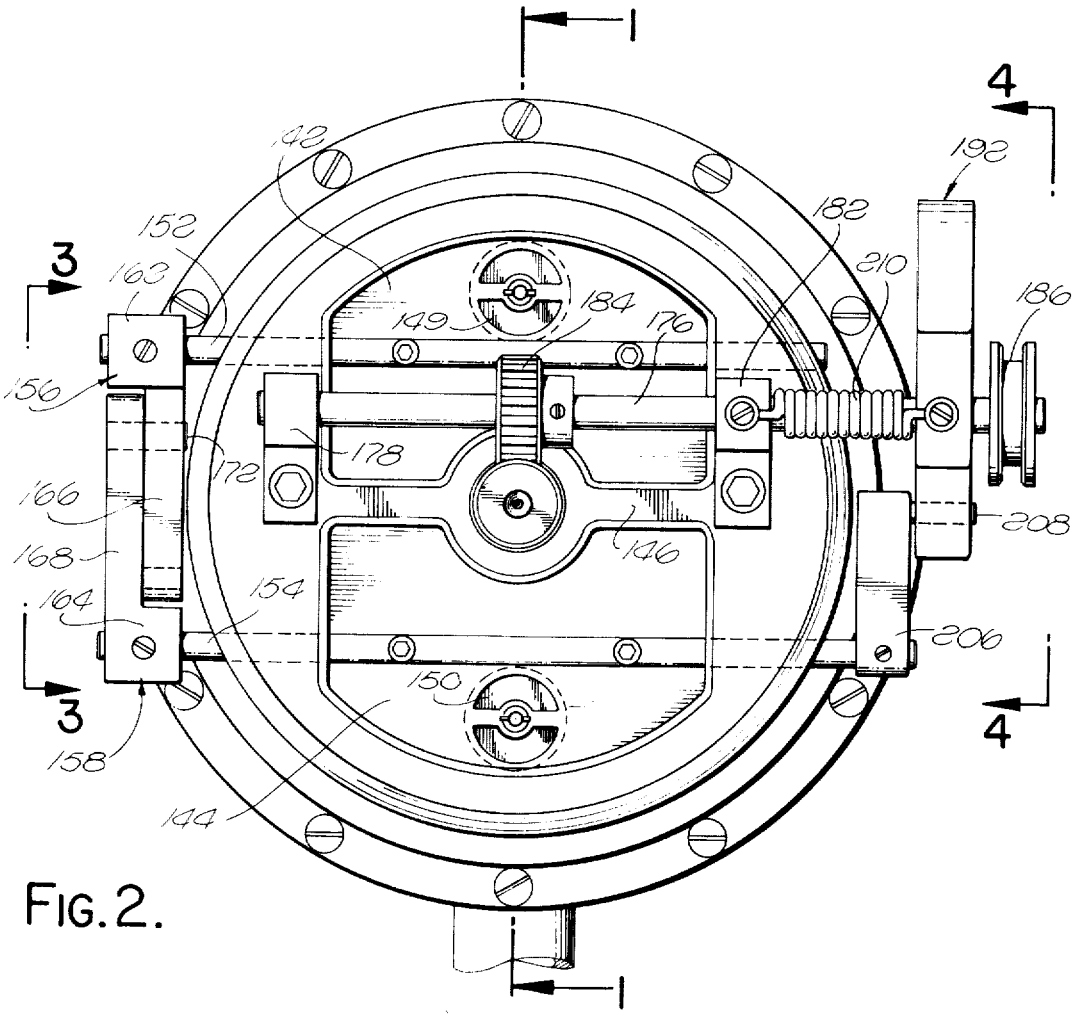
FIG. 2 is a top plan view of the carburetor.
Figure 3:
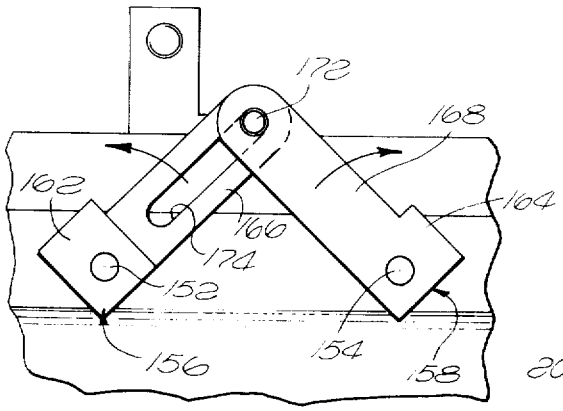
FIG. 3 is a partial side view of the carburetor in a first operational position taken along the line 3—3 of FIG. 2.

A pair of butterfly valves 142 and 144 control the flow of air through the main air intake opening 28. As can be seen in FIG. 2 the valves each have a cross-sectional area such that they can close off the opening defined by the interior surface of the upper housing member 12 and an integral web 146 which extends from the central plug 32 to the upper housing 12. Openings 147 and 148 in the valves 142 and 144, respectively, are closed by relief valves 149 and 150 formed on the valve interior surface when the valves are closed as shown in FIG. 1. The relief valves 149 and 150 are spring-loaded by means of springs 151 so that an air path is formed into the carburetor interior, if necessary, during idling as will be explained hereinafter. The butterfly valves 142 and 144 are rotatably mounted on a pair of transversely extending pins 152 and 154, respectively. The pins extend through the wall of the upper housing member 12. A pair of mirrored L-shaped blocks each have a base 162 and 164, respectively, to which one end of the pins 152 and 154 are secured. The arms 166 and 168 of the pins 152 and 154, respectively, are each slidably movable adjacent to each other. A pin 172 secured to the free end of the arm 168 is movable in a slot 174 which extends the length of the arm 166. When the butterfly valves 142 and 144 are positioned to close the main air intake opening 28 the arms are parallel to each other. As the butterfly valves are rotated to an open position the arms 166 and 168 pivot until at a position shown in FIG. 3 where they are at an intersecting angle of approximately 45°.

A pulley pin 176 is rotatably mounted on a pair of blocks 178 and 182 positioned on opposite sides of a top surface of the upper housing member 12. A pinion gear 184 rotates on the pulley pin 176 and is positioned to mesh with the rack gear 96 formed on the cylindrical sleeve 94. A pulley 186 is secured to one end of the pulley pin 176 and rotates the pulley pin with a throttle cable (shown in FIG. 4) connected to the throttle pedal (not shown) associated with the engine. A cam 192 is also rotatably mounted on the pulley pin 176.

Figure 4:
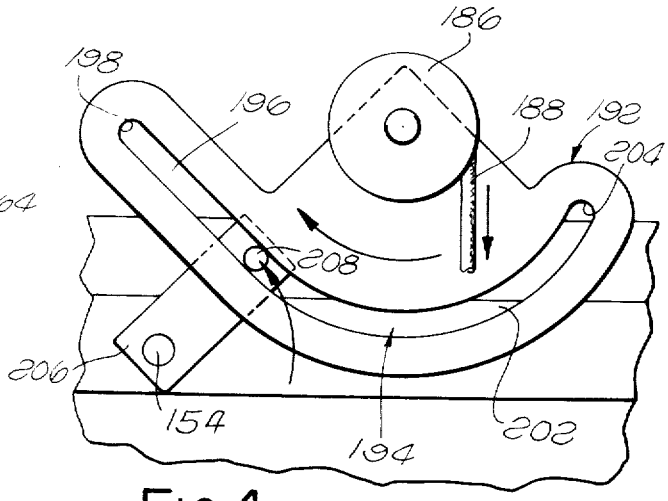
FIG. 4 is a partial side view of the carburetor in the operational position shown in FIG. 3 taken along the line 4—4 of FIG. 2.

Referring now to FIG. 4, a cam slot 194 is formed in the cam 192. The cam slot contains a linear portion 196 which extends from a first end 198 of the slot 194 to a curved portion 202. The curved portion in turn terminates at a second end 204 of the slot 194. The end of the second pin 154 adjacent the cam 192 is secured to one end of a rotatable block 206. The other end of the block 206 has a cam pin 208 affixed thereto which is movable in the cam slot 194. When the butterfly valves 142 and 144 are closed the cam pin is adjacent the first end 198 of the slot. A spring 210 is fastened between the fixed block 182 and the cam 192, causing the valves 142 and 144 to normally tend to remain in the closed position of FIG. 1.

As the throttle of the vehicle is depressed, the cable attached to the pulley 186 causes the pulley pin 176 to rotate and the cam pin 208 moves along the linear portion 196 of the cam slot, thereby causing the butterfly valves 142 and 144 to rotate open. When the butterfly valves 142 and 144 have opened to the maximum air intake position, the cam pin 208 is in the position shown in FIG. 4. Further depression of the throttle causes the cam pin 208 to move along the curved portion 202 of the cam slot 194 but no further movement of the butterfly valves 142 and 144 occurs. However, it should be noted that this further cam pin movement causes further upward movement of the cylindrical sleeve 94.

Referring once again to FIG. 1, a fuel intake 212 extends through the wall of the lower housing. A check valve 214 is used to control the flow of fuel from the intake 212 into the fuel chamber. A float 216 in the fuel chamber is connected to a spring 218 which in turn operates the check valve 214 and controls the flow of fuel into the chamber.

A cup shaped housing 222 is positioned in the bore 72 of the lower housing with a threaded cup bottom wall 224 extending below the bore and the side wall 226 abutting the shoulder 74. A T-shaped plug 228 has a base 232 spaced from the interior surface of the bottom wall 224 by means of a spring 234. The stem 236 of the plug is slidable in the interior of the cylindrical sleeve bore 99 and the base 232 side walls 237 form a sliding fit with the interior of the housing side 226.

The spring 234 exerts an upward force on the T-shaped plug 228 but the force does not exceed that provided by the spring 210 connected to the cam 192 which tends to keep the cylindrical sleeve 94 in a downward position. A first check valve 238 formed in a passageway 242 communicates between the upper and lower surfaces of the T-shaped plug base 232. A second check valve 244 communicates between the fuel resevoir and an opening 246 in the side wall 226 enabling fuel to deposit in the housing 222 between the shoulder 74 and the plug base 232 top surface. A passageway 247 extends from the opening 246 along the side wall 226 of the cup shaped housing, and terminates at a third check valve 248 containing a spring biased ball 252 which tends to keep a passageway 254 in a normally closed position. The passageway 254 extends to the bottom surface of the cup-shaped housing 222.

During sudden spurts of the engine, the spring 234 exerts an upward force on the plug 228, as the sleeve 94 moves upwardly. Fuel rapidly passes into the passageway 247 and past the ball 252 into the manifold, thus avoiding dead spots. The first check valve 238 enables fuel to flow above the base 232 when decelerating, equalizing pressure above and below the base of the T-shaped plug 228.

When the engine is idling and the valves 142 and 144 are in the closed position of FIG. 1, air enters the idle air gap 134 and passes to the upper openings 116 in the cylindrical sleeve 94. Simultaneously, fuel from the fuel chamber passes through the central stem openings 82 to the area intermediate the interior of the central stem 52 and the cylindrical sleeve 94 and into the lower openings 118 formed in the cylindrical sleeve. The fuel then flows upwardly through the reduced diameter lower bore 112 of the cylindrical sleeve, where it mixes with air in the cylindrical sleeve upper openings 116 and passes into the air gap 56. The idle air fuel mixture then moves along the gap toward the housing surfaces and passes downwardly toward the intake manifold of the engine. Adjustment of the air fuel mixture during idling can be performed by rotating the knob 128, thus adjusting the position of the needle 122 at the upper openings 116.

It should be noted at this time that suction from the manifold could also force some slight amount of air to enter from the butterfly valve relief valves 149 and 150. As the throttle is depressed opening the butterfly valves 142 and 144, the cylindrical sleeve 94 simultaneously moves upwardly as the pinion gear 184 meshes with the rack gear 96. As this occurs, the idle air fuel mixture will be cut off as the upper openings 116 are blocked by the bore 98 formed in the hemispheric shaped member 34. However, sufficient fuel now moves into the gap 56 from the area intermediate the central bore 78 of the stem 52 and the tapered outer surface 104 of the cylindrical sleeve 94. Thus, the desired air-fuel mixture is provided to the engine. It should be noted as previously pointed out that once the butterfly valves 142 and 144 are open further movement of the cylindrical sleeve 94 in an upward direction increases the flow of fuel.

Further the gap spacing could be made adjustable, so that the carburetor could be adjusted for installation with use in different engine compressions. This adjustment, however, should not affect the venturi formed at the periphery of the gap 56 adjacent the flanges 16 and 18.

I claim:

1. A carburetor comprising:

a mixture outlet and a connection means to attach said mixture outlet to an intake manifold;

a main air intake spaced from said mixture outlet, said main air intake including a butterfly valve adjustable to control the flow of air into said carburetor;

a fuel inlet;

a pair of spaced apart surfaces forming a fuel path from a central portion of said spaced apart surfaces to the periphery of said surfaces, said periphery of said surfaces being adjacent to the carburetor passageway for enabling the air from the main air inlet to mix with said fuel and pass to said intake manifold;

a central fuel inlet forming a path for fuel from a carburetor fuel resevoir to said surfaces central portion comprising an elongated axially movable tube whose outer surfaces taper; and a cylindrical member whose inner surface surrounds said elongated tube outer surface, said tube and said cylindrical member when spaced apart defining a main fuel path from said fuel resevoir to said central portion of said surfaces;

a secondary inlet forming an air intake passageway when said inlet is closed, said secondary air inlet being defined by a bore formed in the interior of said elongated tube and extending from the carburetor exterior adjacent to the main air intake to the central portion of said surfaces;

a secondary fuel inlet forming a fuel inlet passageway for mixing with air in said secondary air inlet comprising a second bore in said elongated tube and extending from said fuel resevoir to said central portion of said surfaces; and an orifice communicating with said bores and said central portion; and a needle moving with respect to said elongated tube in said first bore for adjusting the flow of the air-fuel mixture in the orifice.

2. A carburetor in accordance with claim 1 wherein a spring-biased relief valve are formed on said butterfly valve.

3. A carburetor in accordance with claim 1 wherein said secondary air inlet is integrally formed with said needle, movement of said needle with respect to said tube forming an idle adjustment for said engine.

4. A carburetor in accordance with claim 3 wherein said needle and said elongated tube are movable in tandem.

* * * * *